US005343492A

United States Patent [19]

Henn

[11] Patent Number: 5,343,492

[45] Date of Patent: Aug. 30, 1994

[54] CLOSED INDUCTION FURNACE FOR THE MELTING AND CASTING OF SUBSTANCES

[75] Inventor: Alfred Henn, Rodenbach, Fed. Rep. of Germany

[73] Assignee: Leybold Durferrit GmbH, Cologne, Fed. Rep. of Germany

[21] Appl. No.: 57,653

[22] Filed: May 5, 1993

[30] Foreign Application Priority Data

Sep. 5, 1992 [DE] Fed. Rep. of Germany ..... 4229764

[51] Int. Cl.[5] ..... F27D 3/00

[52] U.S. Cl. ..... 373/143; 373/142; 75/508; 266/240

[58] Field of Search ..... 373/142, 143, 138, 84; 266/234, 240; 75/508, 584

[56] References Cited

U.S. PATENT DOCUMENTS

| | | | |
|---|---|---|---|
| 2,788,270 | 4/1957 | Nisbet et al. | 75/49 |
| 3,149,959 | 9/1964 | Nicholson | 75/508 |
| 3,311,361 | 3/1967 | Zepernick | 266/240 |
| 3,460,604 | 8/1969 | Tingquist et al. | 164/61 |
| 3,529,069 | 9/1970 | Fredriksson et al. | 373/143 |
| 4,345,747 | 8/1982 | Laimer | 266/240 |
| 4,658,404 | 4/1987 | Sick et al. | 373/143 |
| 4,773,079 | 9/1988 | Bruckmann et al. | 373/141 |
| 5,271,033 | 12/1993 | Bethge et al. | 373/143 |

FOREIGN PATENT DOCUMENTS

| | | |
|---|---|---|
| 3530471 | 3/1987 | Fed. Rep. of Germany . |
| 3844273 | 12/1988 | Fed. Rep. of Germany . |
| 439472 | 12/1935 | United Kingdom . |
| 818638 | 8/1959 | United Kingdom . |
| 831887 | 4/1960 | United Kingdom . |
| 843975 | 8/1960 | United Kingdom . |
| 859809 | 1/1961 | United Kingdom . |
| 949348 | 2/1964 | United Kingdom . |

*Primary Examiner*—Bruce A. Reynolds
*Assistant Examiner*—Tu Hoang
*Attorney, Agent, or Firm*—Felfe & Lynch

[57] ABSTRACT

A crucible (9) surrounded by an induction coil (10) is housed for tilting about a first tilt axis within a gas-tight furnace chamber (2) which has a closable opening (40a) for transferring the melt (31) into a receiving vessel (36, 63). The furnace chamber (2) is in turn tiltable about a second tilt axis (A2) between a melting position and a position in which the start of the pouring of the melt is immediately imminent by an angle which corresponds to the range of the tilting angle of the crucible (9). The opening (40a) for transferring the melt is surrounded by a first sealing flange (41) which, after the tilting path of the furnace chamber (2) has been traveled, comes sealingly into contact with a second sealing flange (38, 64) of an additional gas-tight chamber (35, 61) in which the receiving vessel (36, 63) for the melt is situated.

10 Claims, 5 Drawing Sheets

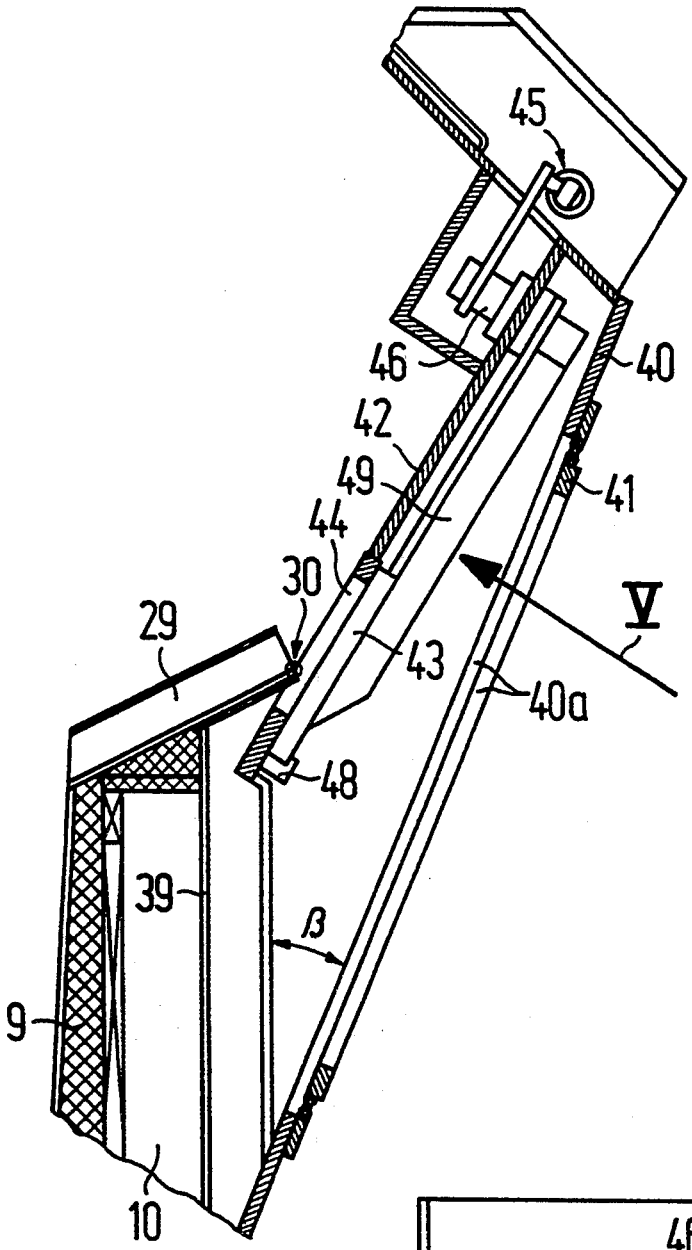
FIG.4
FIG.5
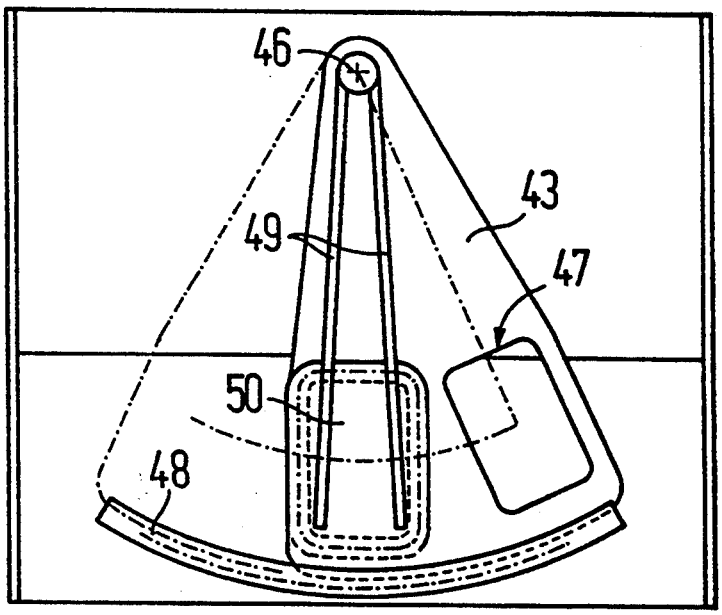

CLOSED INDUCTION FURNACE FOR THE MELTING AND CASTING OF SUBSTANCES

BACKGROUND OF THE INVENTION

The invention relates to a closed induction furnace for the melting and casting of substances. A crucible surrounded by an induction coil is housed for tilting about a first axis in a gas-tight furnace chamber which has a closable opening for transferring the melt to a receiving vessel.

The term "closed induction furnace," means a furnace of this kind whose furnace chamber can be operated either with a vacuum and/or with a shielding gas. It is also possible to employ the different types of operation successively in order to perform different alloying and/or refining operations.

U.S. Pat. No. 3,460,604 discloses tiltable crucibles surrounded by an induction coil housed in a stationary furnace chamber. This furnace chamber must then be made big enough so that the crucible, starting from its melting position with its axis perpendicular, can be tilted by an angle of decidedly more than 90 degrees, until it is completely emptied. This type of construction necessitates furnace chambers with a considerable internal capacity and therefore it requires either long evacuation periods and/or powerful pumps and/or large amounts of shielding gases. Since it is expedient first to evacuate furnaces operated under shielding gases so as to save on the relatively expensive noble gases, the furnace chambers must therefore withstand the pressure of the atmosphere against a vacuum, so that expensive and heavy furnace chambers are required.

The interior capacities of such furnace chambers become still larger when the vessel for receiving the poured metal, a casting mold, an ingot mold or a ladle is also housed in it (U.S. Pat. No. 2,788,270).

These disadvantages were recognized early, and a type of furnace was created in which the furnace chamber surrounds the crucible to a certain extent like a mantle, so that the furnace can be tipped as a whole (U.S. Pat. No. 3,529,069 and German Patent 35 30 471). Disadvantageous in this case are the large masses that have to be moved, and this movement must be performed as smoothly as possible to avoid any disturbance of the pouring process.

The problems, diametrically opposed to one another, increase disproportionately as the size of the charge increases, and with it the size of the crucible.

Another disadvantage of previously known solutions lies in the necessity of having to provide expensive systems for transferring the melt into other chambers if the pouring and solidification are to be performed in a vacuum and/or under shielding gas. In this case, again, the problems increase disproportionately as the charge weight increases.

SUMMARY OF THE INVENTION

The invention is therefore addressed to the task of devising a closed induction furnace having a minimal internal volume and in which the masses that have to be moved during the teeming process are kept small.

The task is accomplished by making the furnace chamber tiltable about a second tilt axis by an angle that corresponds substantially to the angular tilting range of the crucible, which is between the melting position and a position wherein the pouring of the molten metal is just about to begin. The opening of the furnace chamber for the transfer of the melt is surrounded by a first sealing flange which closes the furnace chamber after the latter has completed its tilting movement, and comes in contact with a second sealing flange on an additional gas-tight chamber in which the vessel for receiving the melt is situated.

An induction furnace of this kind makes possible an especially advantageous operating process which is likewise subject matter of the invention.

First the melting of the material is performed with the crucible axis vertical and with the pouring opening closed. After the melting is done the crucible and furnace chamber are tilted together about the second tilt axis until the sealing flanges are gas-tight against one another, while the pouring of the molten material is just about to begin. The gas-tight chamber with the receiving vessel is then evacuated and the pouring opening is opened, and lastly the crucible is moved to its end position with the furnace chamber stationary while the amount of metal poured per unit time is regulated.

Such an induction furnace has a minimal internal capacity, so that the evacuation can be performed quickly and with a relatively low pumping capacity. If inert or shielding gas is used, the consumption of these gases, which as a rule are expensive, is also minimized. Large masses need to be moved only up to a point in time just before the pouring begins. As soon as the pouring time has arrived, only the crucible, which has a relatively low weight despite its being constructed with an induction coil and supporting frameworks, is moved smoothly about the crucible tilt axis, so that a very precise control of the amount of metal poured per unit time is possible.

The means for transferring the melt from the furnace chamber to an additional chamber containing a vessel for receiving the melt can be made surprisingly simple. Especially, no complicated axial pass-throughs are needed as they are in U.S. Pat. No. 3,529,069 and German Patent 35 30 471.

BRIEF DESCRIPTION OF THE DRAWINGS

FIG. 4 is a vertical section showing the pouring opening of FIG. 2 in detail.

FIG. 5 is a plan view of the pouring opening seen in the direction of the arrow V in FIG. 5.

DETAILED DESCRIPTION OF THE PREFERRED EMBODIMENT

Figure 1:
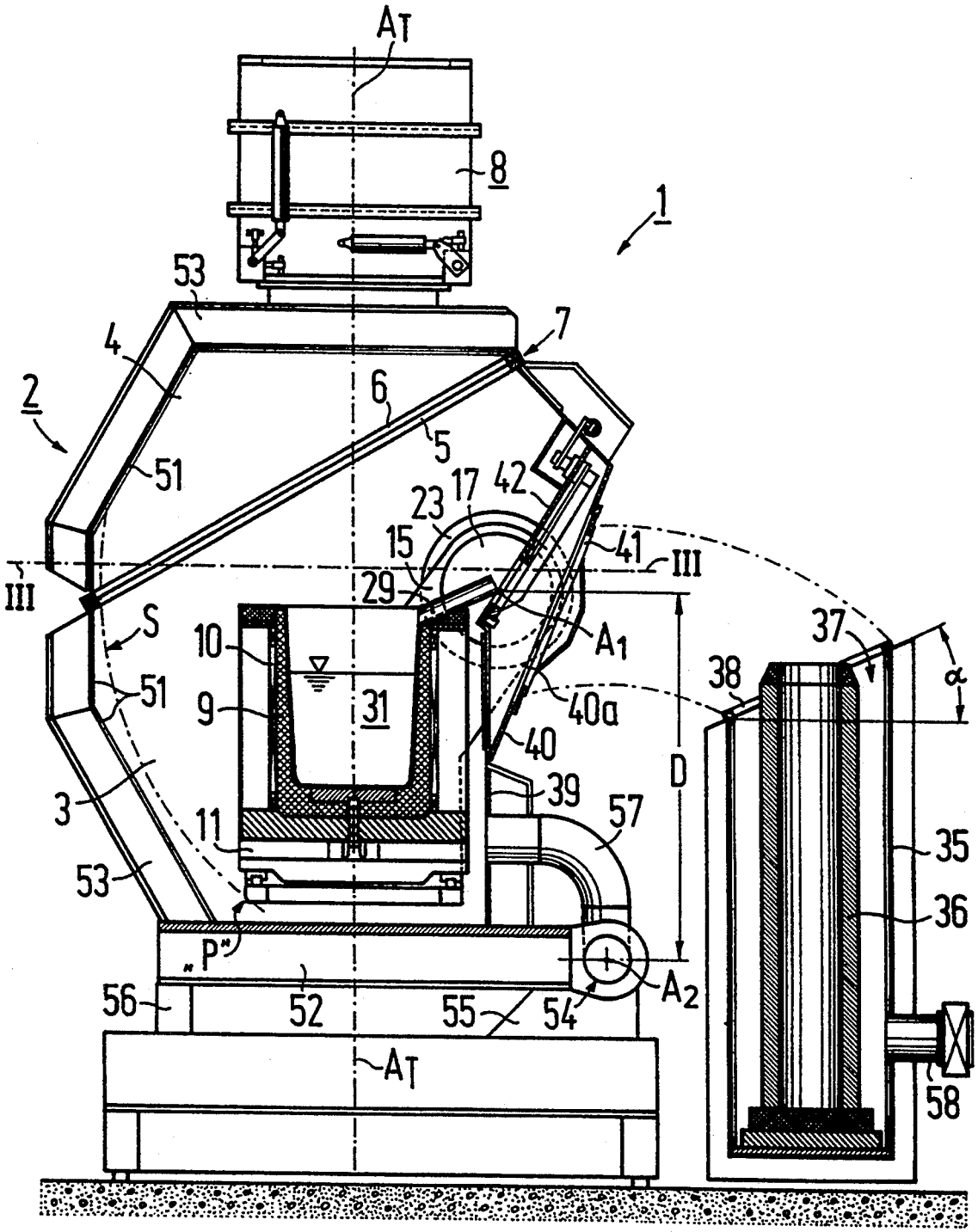
FIG. 1 shows a vertical section through a first embodiment, in the melting position, i.e., with the furnace chamber and the chamber for the receiving vessel separated, while the receiving vessel contains an upright mold for an ingot.

In FIG. 1 there is shown a closed induction furnace 1 which has a furnace chamber 2 consisting of a bottom part 3 and an upper part 4, and has two sealing flanges which abut against one another at a parting line 7. On the upper part 4 of the chamber there is a charging air lock 8 which serves for charging the furnace chamber with the material to be melted.

Under the charging air lock 8 is a crucible 9 which can be tilted together with an induction coil 10 surrounding it about a first tilt axis $A_1$. The crucible 9 and the induction coil 10 are on a tilting platform 11.

Figure 3:
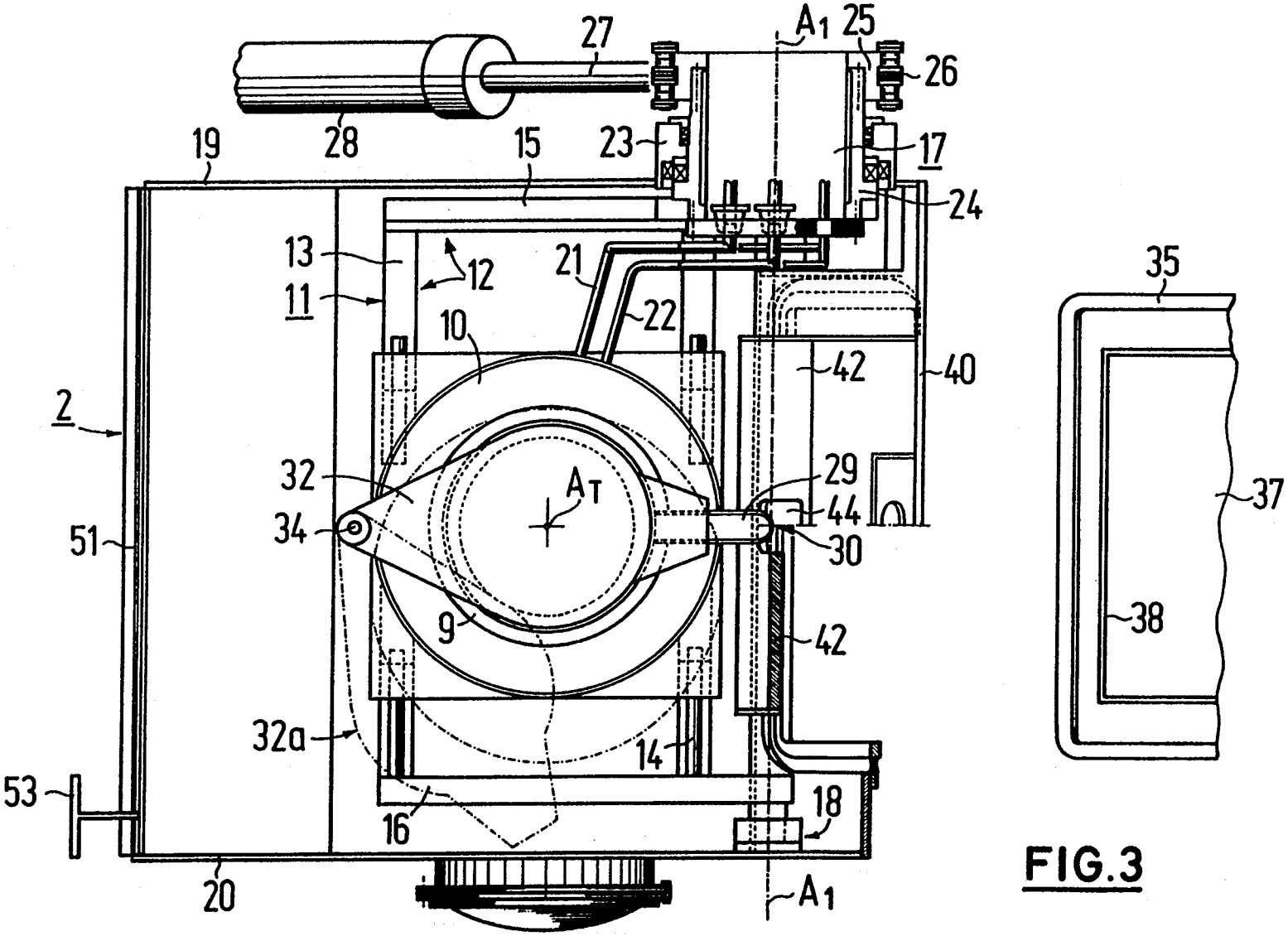
FIG. 3 shows a horizontal section through the subject of FIG. 1 along the line III—III.

Referring to FIG. 3, the tilting platform 11 includes a basic frame 12 with cross members 13 and 14 which form the yokes of two upwardly pointing arms 15 and 16 through whose upper end the first tilt axis $A_1$-$A_1$ passes. This first tilt axis is physically formed by a bushing 17 and a bearing 18 which are held by planar side walls 19 and 20 of the furnace chamber 2. The bushing 17 also serves to carry the coil current and cooling water through the lines 21 and 22. The bushing 17 includes a bearing ring 23 surrounding a circular opening in the side wall 19, and a hollow shaft 24 bearing on its outer end a sprocket 25 on which a roller chain 26 is placed, whose one end is joined to the piston rod 27 of a hydraulic jack 28. Since the hollow shaft 24 is corotational with the arm 15, the tilting platform 11 and with it the crucible 9 can be tilted about the axis $A_1$-$A_1$ relative to the furnace chamber 2.

The crucible 9 has a casting spout 29 with a lip 30 which is located as accurately as possible on the tilt axis $A_1$-$A_1$. The crucible 9 has a crucible axis $A_T$-$A_T$ which in the melting position shown in FIG. 1 is vertical. Above the crucible interior in which the molten metal 31 is contained, a radiation shield 32 is disposed, which can be swung by means of a drive 33 not shown and a drive shaft 34 to a position 32*a* shown in dash-dotted lines, for the purpose of being able to charge the crucible through the charging air lock 8.

In front of the furnace chamber 2 is an additional gas-tight chamber 35 in which is a receiving vessel 36 for receiving the molten metal 31, and this vessel can be in the form of an upright ingot mold. Chamber 35 has at its upper end an opening 37 surrounded by a sealing flange 38 which is at an angle $\alpha$ of about 30 degrees from the horizontal.

Figure 2:
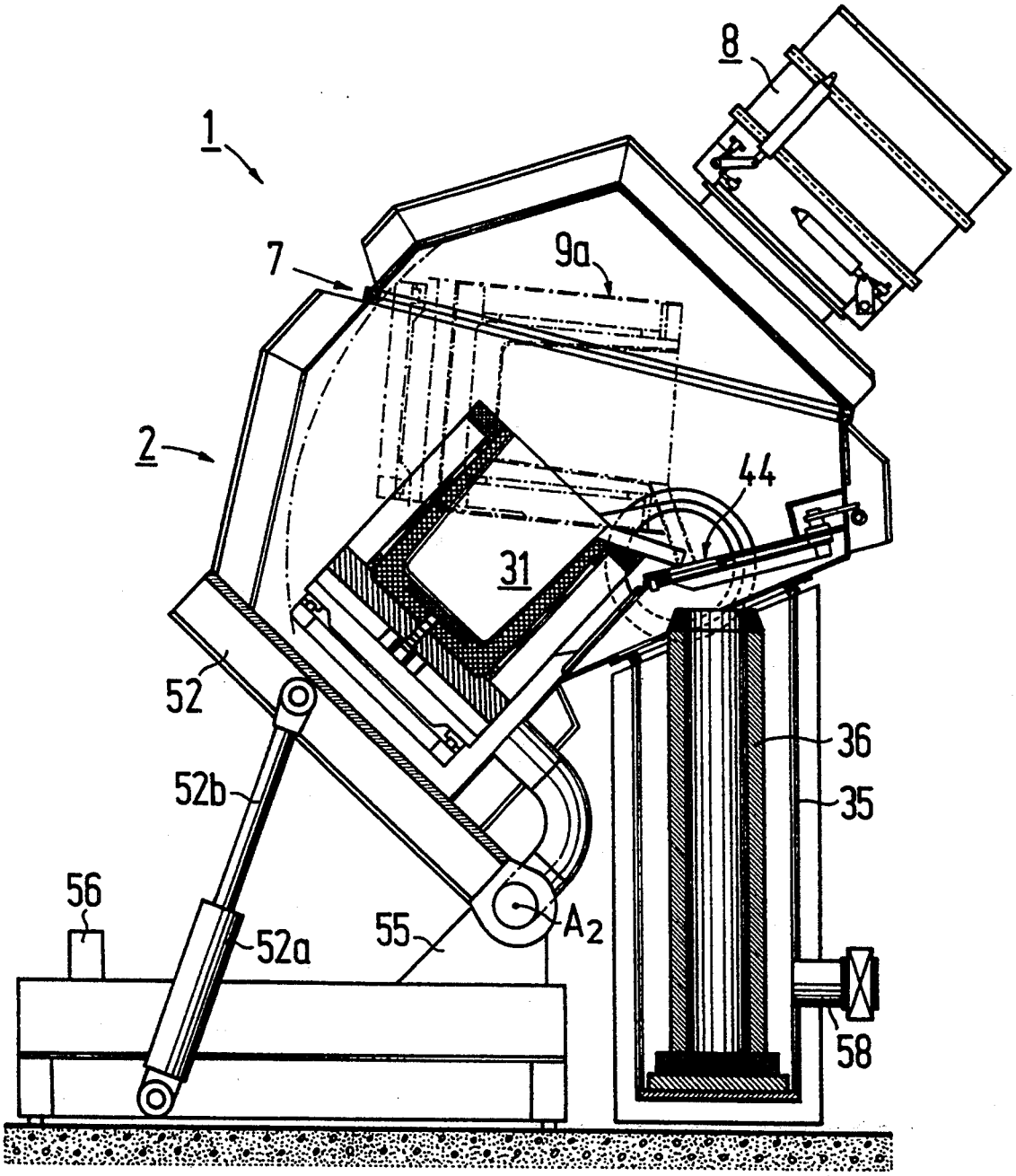
FIG. 2 shows the subject matter of FIG. 1 after the furnace chamber has reached its end position wherein it is joined to the second chamber, and in which the crucible is in its starting position at the start of the pour into the upright mold.

It can be seen in FIG. 1 that the induction coil 10 of the crucible 9 in the latter's melting position is directly adjacent a vertical wall 39 which belongs to the furnace chamber 2 and to the gas-tight chamber 35 for the receiving vessel 36. From the wall 39 runs another wall 40 which is at an acute angle B likewise of about 30 degrees to the vertical wall 39 and has an opening 40*a* which is surrounded by a first sealing flange 41. The furnace chamber 2 can be tilted about a second tilt axis $A_2$, the arrangement being made such that the sealing flange 41 lies congruently on the sealing flange 38 at the end of the tilting movement of chamber 2 about axis $A_2$ and thus forms a gas-tight joint as represented in FIG. 2. The chamber 35 thus forms, so to speak, the closure of the furnace chamber in the pouring position shown in FIG. 2.

The position of the second tilt axis ($A_2$) of the furnace chamber (2) is selected such that the lip (30) of the crucible (9) can be positioned over the receiving vessel (36) in the pouring position. Furthermore, the horizontal tilt axis ($A_2$) of the furnace chamber (2) lies in a vertical plane bisecting a straight line connecting the position of the pouring lip (30) in the melting position with the position of the pouring lip (30) in the pouring position. The vertical plane is the so-called central perpendicular to the straight connecting line.

As shown in FIG. 4, there is an inner wall 42 between lip 30 of the crucible 9 and the outward leaning wall 40 of the furnace chamber 2, which leans outwardly at an acute angle $\beta$ and bears the first sealing flange 41. A pouring opening 44 is situated in the wall 42 in the area of the lip 30, and can be closed by a slide 43.

Referring also to FIG. 5, the slide 43 is a sector-shaped plate which can be rotated by means of a drive link 45 and a shaft 46. A window 47 in the slide plate can be brought into line with the pouring opening 44 by swinging the slide plate. The slide plate 43 is guided at the outer circumference by a partially circular guiding rail 48 and is urged against the wall 42 and the pouring opening 44 by a radial arm 49 with a pressure plate 50. The purpose of the slide 43 is to close the furnace chamber hermetically in the melting position shown in FIG. 1, so that the melting operation can be performed under a vacuum and/or shielding gas.

In the melting position shown in FIG. 1, the seam 7 between the two sealing flanges 5 and 6 of the furnace chamber 2 is at an acute angle of about 35 degrees from the horizontal (line III—III).

The wall 51 of the furnace chamber 2, facing away from the pouring lip 30 of the crucible 9 and composed of a plurality of sections in a polygonal arrangement, has a shape corresponding approximately to the path "S" of the movement of a point "P" on the base frame 52 represented in dash-dotted lines and offset diagonally from the pouring lip 30. According to FIG. 2, the furnace chamber 2 can be tilted by means of a hydraulic jack 52*a* and a piston rod 52*b*. These details are omitted from FIGS. 1 and 3.

As shown in FIG. 1, the individual sections of the wall 51 are divided into a chamber bottom 3 and a chamber top 4. The individual chamber walls are reinforced by T-beams 53, as also indicated in FIG. 3. The base frame 52 of the furnace chamber 2 is horizontal in the melting position shown in FIG. 1, and bears on its end facing the chamber 35 two bearings 54 of which only the front bearing is visible in FIG. 1. The bearings 54 are disposed in a bearing support 55 and the base frame 52 rests at its end on that supports 55 and 56.

The furnace chamber 2 can be evacuated through a vacuum line 57 which is connected through a swivel joint not further described to a set of vacuum pumps. The swivel joint is coaxial with the second tilt axis $A_2$. In this manner the furnace chamber 2 can be kept under vacuum not only during the melting operation but also during the tilting movement, which leads finally to the position shown in FIG. 2.

With the apparatus according to FIGS. 1 to 5, the following operating process can be performed:

At first the furnace chamber 2 and crucible 9 are in the position shown in FIG. 1. In this position, after the radiation shield 32 has been swung away, the crucible can be charged with material to be melted. After evacuation through the vacuum line 57, electrical energy and cooling water are supplied to the induction coil 10 through the lines 21 and 22 of the rotary connection 17, until the entire content of the crucible 9 has been melted and subjected to any additional metallurgical treatments.

After the end of the treatment, the furnace chamber 2 and crucible 9 are together rotated about the second tilt axis $A_2$ of the furnace chamber 2, until the sealing flanges 41 and 38 are against one another sealingly in the position shown in FIG. 2. The design data concerning the tilt are selected in consideration of the crucible content so that the pouring of the molten material in the position of the furnace chamber 2 shown in FIG. 2 is just about to begin. The furnace chamber 2 is joined hermetically to the chamber 35, which if necessary has an additional vacuum line 58 for connection to vacuum pumps not shown here. Then the pouring opening 44 is opened by rotating the slide 43 (FIGS. 4 and 5) and the crucible 9 is moved continuously and controlledly, with the furnace chamber stationary, all the way into the end position 9*a* represented in dash-dotted lines in FIG. 2. The angular velocity of the crucible about the first tilt axis $A_1$-$A_1$ (which was rotated in space together with the furnace chamber 2 into the position represented in FIG. 2) is controlled on the basis of the amount poured per unit time. It can be seen from FIG. 2 that during the HP LaserJet IIIHPLASIII.PRS It can be seen that chamber 35 is also only slightly larger than the receiving vessel 36. The entire interior of furnace chamber 2 and chamber 35, which is under a vacuum and/or shielding gas, is minimal, considering the required freedom of movement of the crucible 9. The operating process in accordance with the invention is especially appropriate for all metallurgical pouring methods involving direct casting or teeming through pouring spouts or casting molds, e.g.:

chill casting (electrodes, forging billets, bar sticks)
mold casting (fine casting)
fast-hardening casting (shock cooling)
powder spraying
spray deposition (compacting)
strand casting (horizontal or vertical).

Figure 6:
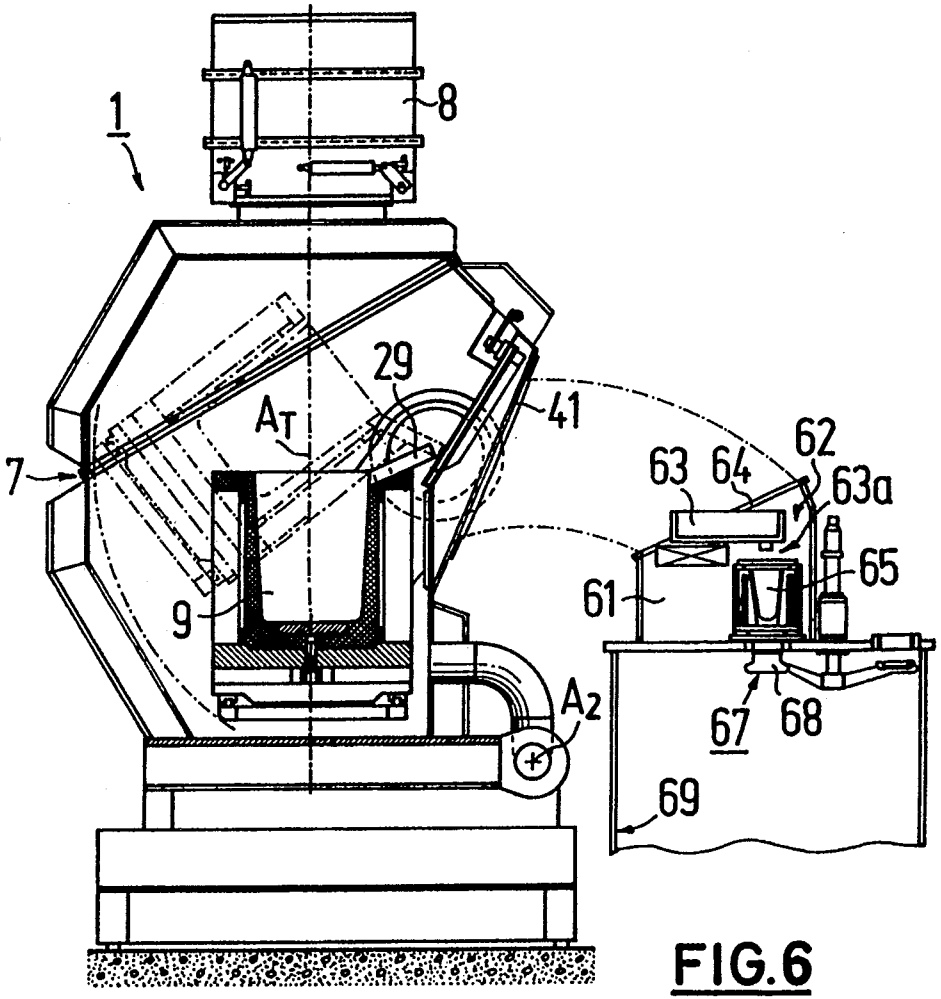
FIG. 6 is a vertical section through a second embodiment in a position similar to FIG. 1, but with an intermediate vessel in the receiving vessel and with a nozzle system for producing powder.
Figure 7:
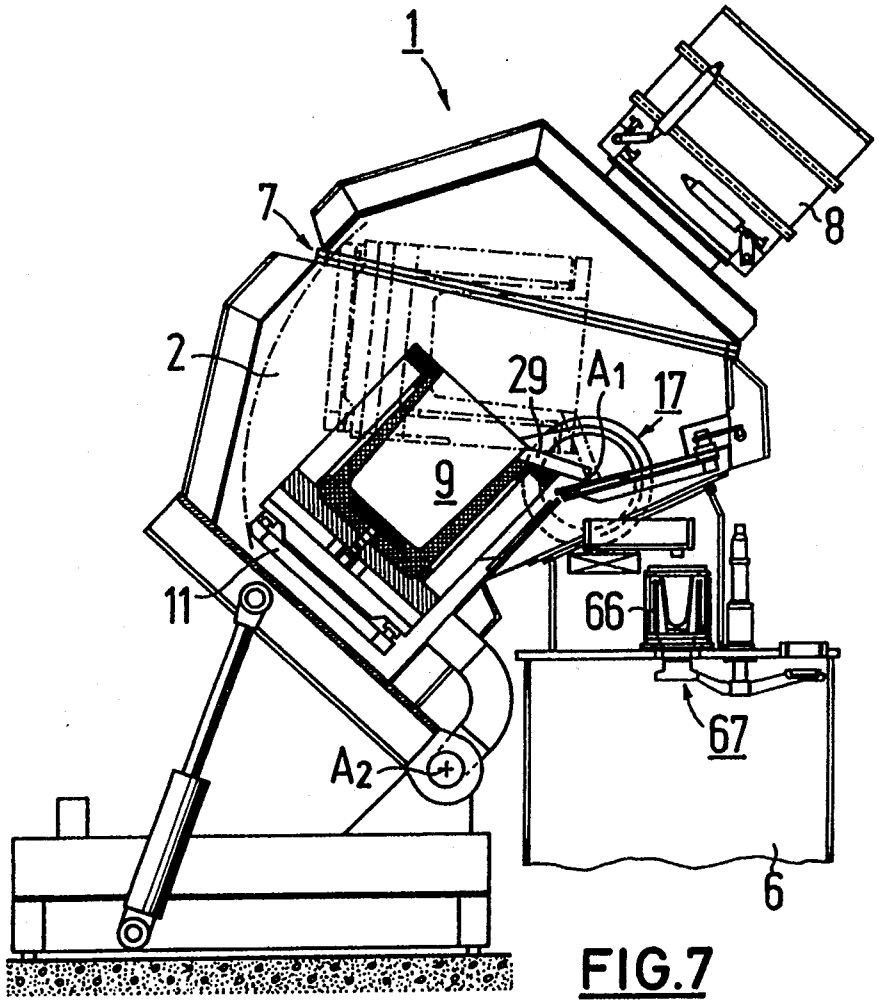
FIG. 7 shows the subject of FIG. 6 after the furnace chamber has reached its end position in which it is joined to the second chamber, and in which the melting crucible is in its starting position for the pour into the intermediate vessel.

An apparatus for the production of powders is represented in FIGS. 6 and 7.

The induction furnace 1 is of the same construction as that of FIGS. 1 to 5. The difference is, however, that in the additional chamber 61, a receiving vessel 63 is disposed in its opening 62, and into it the melt is transferred from the crucible 9 by means of the pouring spout 29. Here, too, the opening 62 is surrounded by a sealing flange 64 which can be hermetically sealed to the sealing flange 41 of the furnace chamber 2 (see FIG. 7).

The receiving vessel 63 has an outlet 63*a* under which a pouring funnel 65 is situated, in whose bottom a stream opening, not otherwise represented, is situated. The pouring funnel 65 is surrounded by a heating coil 66. Underneath the stream opening and coaxial therewith there is a nozzle system 67 which contains one of the well-known annular slots 68 for the stream of material. By passing a compressed gas through the annular slot 68 the molten stream is broken up and reduced to particles of powder which are caught after solidification in a powder box 69. Details of such a powder-making apparatus are, in themselves, state of the art, so that further explanations are unnecessary.

I claim:

1. Closed induction furnace for melting and casting of materials, said furnace comprising a furnace chamber having a first opening surrounded by a first sealing flange and closure means for making said furnace chamber gas tight, a crucible surrounded by an induction coil in said furnace chamber, said crucible being tiltable relative to said chamber about a first tilt axis to pour molten material through said first opening, a receiving chamber having a second opening surrounded by a second sealing flange and containing a receiving vessel which receives said molten metal, means for tilting said furnace chamber about a second tilt axis from a melting position to a pouring position so that said first sealing flange comes sealingly into a contact with said second sealing flange when said furnace chamber is in the pouring position.

2. Closed induction furnace as in claim 1 wherein said crucible has a pouring lip through which said first tilt axis passes, said pouring lip being directly over said receiving vessel when said furnace chamber is in the pouring position.

3. Closed induction furnace as in claim 2 wherein said furnace chamber comprises a vertical wall adjacent to said receiving chamber, said induction coil being parallel to said vertical wall when said furnace chamber is in the melting position.

4. Closed induction furnace as in claim 3 wherein said furnace chamber further comprises an outward leaning wall above said vertical wall, said first sealing flange being fixed to said outward leaning wall.

5. Closed induction furnace as in claim 4 wherein said second sealing flange lies in a plane at 10° to 45° from horizontal.

6. Closed induction furnace as in claim 4 wherein said furnace chamber further comprises an inner wall between said pouring lip and said outward leaning wall, said inner wall having a casting opening to which said closure means is fixed slidably.

7. Closed induction furnace as in claim 2 wherein said furnace chamber comprises a rear wall remote from said receiving chamber, said rear wall being profiled to closely accommodate said crucible as said crucible is tilted about said first axis relative to said furnace chamber.

8. Closed induction furnace as in claim 2 wherein said second tilt axis lies in a vertical plane bisecting a straight line connecting the pouring lip in the melting position of the furnace chamber to pouring lip in the pouring position of the furnace chamber.

9. Closed induction furnace as in claim 1 wherein the first tilt axis is parallel to the second tilt axis.

10. Closed induction furnace as in claim 1 wherein said crucible is tiltable about said first axis through a first angle and said furnace chamber is tiltable about said second axis through a second angle, said first angle being at least substantially equal to said second angle.

* * * * *